United States Patent [19]

Vallee

[11] 4,370,639

[45] Jan. 25, 1983

[54] HIGH CAPACITY CHANGE-OVER POWER SUPPLY FUSE

[75] Inventor: Guy Vallee, Ste. Catherine, Canada

[73] Assignee: Northern Telecom Limited, Montreal, Canada

[21] Appl. No.: 236,755

[22] Filed: Feb. 23, 1981

[51] Int. Cl.[3] ..... H01H 85/26

[52] U.S. Cl. ..... 337/230; 337/237

[58] Field of Search ..... 337/186, 194, 208, 227, 337/230, 237

[56] References Cited

U.S. PATENT DOCUMENTS 1,462,195 7/1923 Doyle ..... 337/230

FOREIGN PATENT DOCUMENTS 2268348 11/1975 France ..... 337/230

*Primary Examiner*—George Harris

*Attorney, Agent, or Firm*—Sidney T. Jelly

[57] ABSTRACT

A high capacity change-over power supply fuse has an elongate fuse element holder, with fuse element mounting positions at each end. Sliding of the holder move one or the other of the fuse elements into contact with contact members mounted on the supply buses. The fuse element not in contact with the contact members is accessed through an aperture in a cover over the holder and contact members, a clip in cover fitting in the aperture. An aperture, is provided at each end of the cover for access to each fuse element when in a non-active position. Only the contact members need be silver plated, reducing the cost relative to conventional rotary change-over units.

9 Claims, 3 Drawing Figures

HIGH CAPACITY CHANGE-OVER POWER SUPPLY FUSE

This invention relates to high capacity change-over power supply fuses, and in particular to such fuses used in power supply installations where, in the event of a fuse element "blowing" it is necessary to be able to immediately switch over to an alternative fuse element. A typical example of an installation is the power supply to central offices of telephone systems.

A change-over fuse as now used in power supplies for telephone systems central offices, comprises a blade of silver plated copper, which is rotatable through 180° by a handle, whereby one or the other of two fuse elements is connected into the power supply line. The fuse elements and associated bus-bars are housed in an enclosure and the fuse elements are accessible from the front via pull-out members. The pull-out members are locked in position by a locking member associated with the handle whereby only the pull-out member associated with the fuse element not connected can be removed for access to the fuse element.

There are several disadvantages with the apparatus. There is a large area of silver plated copper, comprising the rotating blade and the two alternative sets of contacts with which the blade mates. Misalignment between blade and the contacts can cause problems in inserting the blade between the contacts, when the blade is rotated. The apparatus is also relatively expensive to manufacture.

The present invention provides an arrangement in which a fuse element carrier is slid laterally, whereby one or other of two elements positioned in the carrier, is caused to enter between opposed contacts at each end. Access is provided for changing the fuse elements, but the arrangement is such that only that element not in connection with the supply line is accessible. The fuse element in the power supply circuit is not accessible. There is considerable reduction in silver plating requirements, misalignment problems are avoided and the apparatus is inexpensive to manufacture.

The invention will be readily understood by the following description of an embodiment, by way of example, in conjunction with the accompanying drawings, in which.

Figure 1:
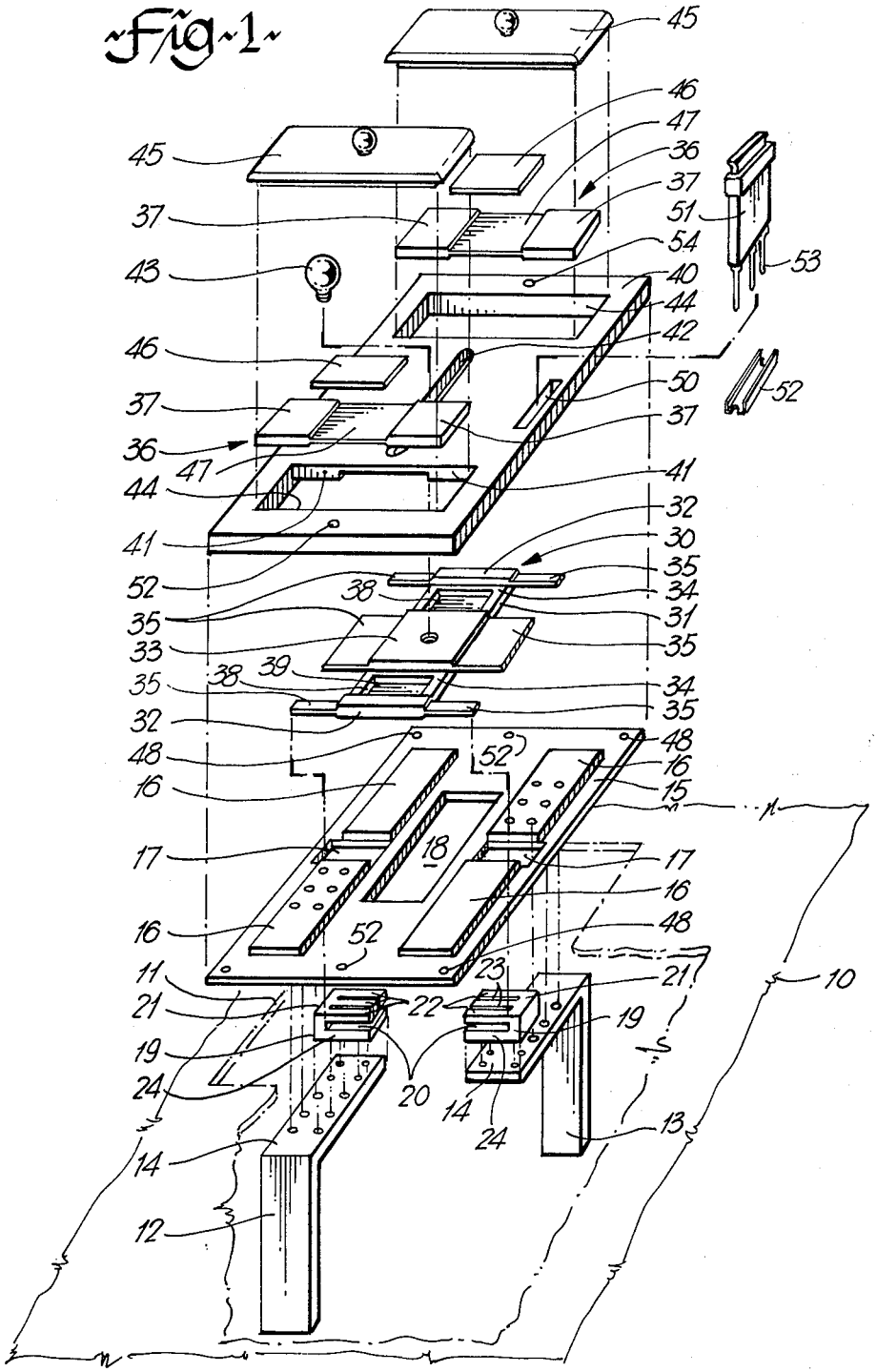
FIG. 1 is an exploded perspective view of a fuse assembly.

Considering FIG. 1, the front face of an enclosure is indicated generally at 10, with an aperture 11 therein. The fuse assembly comprises two bus-bars 12 and 13, bus 12, for example, being the incoming connection from a power source and bus 13 being the outgoing connection to the load. The buses are offset laterally, and, generally, longitudinally. The actual shape or form of the buses 12 and 13 can vary depending upon the installation.

On the top surface 14 of the buses is attached a support member 15, the support member spanning the bus bars laterally and longitudinally. On the top surface of the support member 15 are four pads 16, in two pairs spaced laterally, a pair on each side of the support member. Between each pair of pads an aperture 17 is formed in the support member, and there is also a central aperture 18.

Extending up through each aperture 17 is a contact member 19. Each contact member is attached to a bus bar and the contact members are in lateral alignment. Each contact member has a transverse slot 20, the slots opening towards each other, and the top part 21 of each contact member, in the example illustrated, is divided into three sections 22 by slots 23. The thickness of the bottom part 24 of each contact member is such that the bottom surface of each transverse slot 20 is level with the top surfaces of the pads 16.

A fuse element holder 30 has an elongate main portion 31 which rests on and slides longitudinally, on the top surface of the support member, fitting betwen the pads 16. The holder has two end sections 32, and a central section 33, which define two shallow grooves or channels 34. The end sections 32 and central section 33 have sideways, or laterally, extending flanges 35. These flanges are of a thickness to pass through the slots 20 and rest on top of the pads 16. Two fuse elements 36 rest in the channels 34, the end members 37 of the fuse elements projecting to be between the flanges 35. The end members are a close sliding fit in the slots 20.

Apertures 38 are formed in the channels 34, the apertures having five metal gauze members 39 therein. The apertures 38 and gauze members 39 permit escape of gases when a fuse element "blows" or melts. However, the gauze is sufficiently fine that molten metal, i.e. lead, will not drop through into the interior of the housing, being retained by surface tension and rapid cooling to solidification.

At a central position, the central section 33, of the holder 30, is positioned so that its flanges 35 are in the slots 20. If the holder is moved in one direction, one fuse element connects to the contact members 19 and if moved in the other direction the other fuse element connects to the contact members 19.

A cover 40 fits over the support member 15 and the holder 30, two spaced ribs 41 on the underside of the cover resting lightly on the flanges 35 to assist in guiding and locating the holder. A central slot 42 permits the shank of knob 43, attached to the holder 30, to slide back and forth. Two apertures 44 in the cover provide for access to the fuse elements 36. Clip in covers 45 fit in the apertures 44. Two cover members 46 rest on the center portions 47 of the fuse elements, and move with the fuse elements to prevent any contact with a fuse element occurring through the slot 42. The cover 40 is attached to the support member by screws passing through holes 48 in the support member into threaded holes in the cover.

It will be seen that when the knob 43 is pushed to one end of slot 42, for example to the top in FIG. 1, then the lower of the two fuse elements 36 will connect betwen the contact members 19. The top fuse element will be opposite the top aperture 44 in the cover 40, and removal of the top cover 45 will enable the top fuse element to be removed and replaced. Removal of the bottom cover 45 will create no danger as no fuse element is opposite the lower aperture 44. Sliding of the knob 43 down to the other lower end of the slot 42, will bring the top fuse element into connection with the contact members 19 and the lower fuse element will then be accessible through the lower aperture 44. Thus switching from one fuse element to the other is very simple and easy, just sliding of the knob 43. Instead of a knob, some other form of handle can be used.

As the fuse elements 36 only rest in the channels 34, there is some freedon of movement and therefore the end members 37 of the fuse elements can readily align with the slots 20 if any slight misalignment should occur. The dividing of the top parts 21 of the contact members 19, into sections 22, also permits relative movement between the sections, to assist in ensuring good entry of the fuse element and good contact. The only parts requiring silver plating are the contact members 19.

Figure 2:
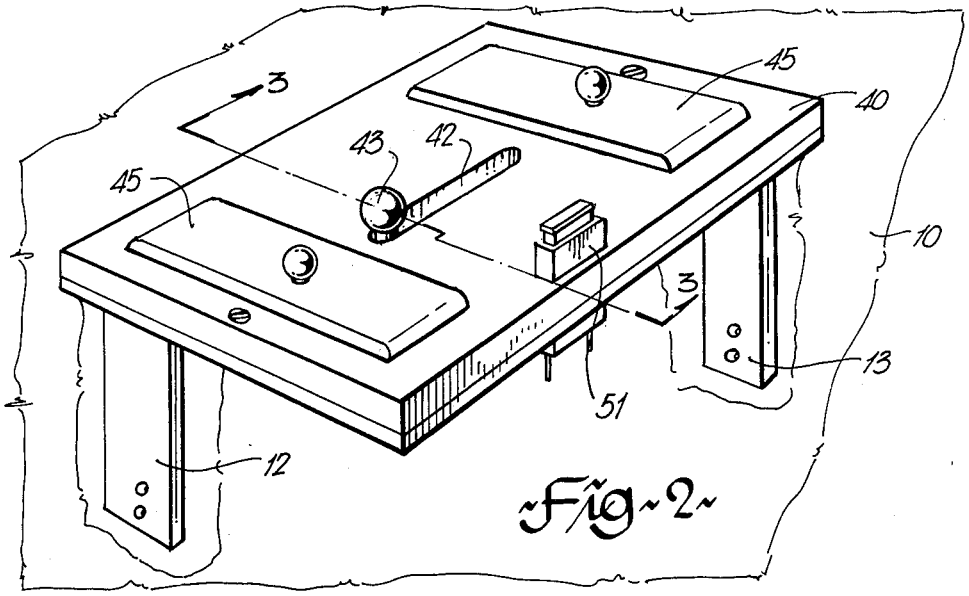
FIG. 2 is a perspective view of the assembled members.
Figure 3:
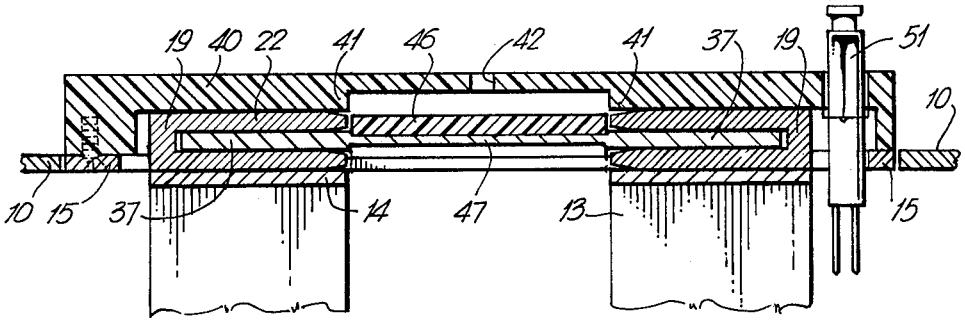
FIG. 3 is a cross-section on the line 3—3 of FIG. 2.

It is usual to provide an alarm device to indicate that a fuse element has "blown". A slot 50 in the cover 40 permits insertion of an alarm fuse 51 from the front. As seen in FIGS. 2 and 3, the alarm fuse passes through the slot 50 in the cover, spring clip 52 holding the fuse in place. The alarm fuse also passes through the end of one of the apertures 17 in the support member 15. Terminals 53 extend from the inner end of the alarm fuse, usually three terminals, are connected to the supply bus, one to the load bus and one to the alarm. When a fuse element "blows", the alarm fuse also blows and passes a signal to the alarm, causing the alarm to sound.

The bus bars 12 and 13 are of copper, while the support member 15, pads 16, holder 30, cover 40, covers 45 and cover members 46 are of insulating material, for example glass fiber reinforced plastic. The assembly is attached to the enclosure by bolts passing through holes 54. The contact members 19 are also of copper and are attached to the bus-bars by, for example, screws or bolts and nuts, and the support member 15 is attached to the bus-bars also by screws. The contact members are the only parts which require silver plating.

FIG. 2 illustrates the various parts in an assembled condition and attached to the housing or enclosure 10. The knob 43 is shown at the lower and left end of the slot 42, which will thereby result in the upper fuse element 36 being in contact with the contact members 19, as in FIG. 3.

What is claimed is:

1. A high capacity change-over power supply fuse, comprising:

an incoming bus and an outgoing bus, spaced laterally;

a support member extending over said buses, and two apertures in the support member in lateral alignment, an aperture over each bus;

a contact member mounted on each bus and projecting through said apertures in the support member;

a fuse element holder mounted on said support member to slide longitudinally, in either of two directions, relative to said contact members, said holder including two fuse element mounting positions spaced apart along the holder, a mounting position on either side of said contact members;

a cover over said support member and said holder, said cover having two apertures spaced apart, one on each side of said contact members, and positioned such that when one of said fuse element mounting positions is between said contact members the other of said fuse element mounting positions is beneath one of said apertures in said cover for access thereto;

means extending through said cover for sliding said fuse element holder longitudinally in either of said directions, movement in one direction positioning a first fuse element in a first said mounting positions in contact with said contact members and positioning a second fuse element in a second of said mounting positions under one of said apertures in said cover, movement in the other direction positioning said second fuse element in contact with said contact members and positioning said first fuse element under the second of said apertures in said cover, a fuse element positioned under either of the apertures in the cover capable of being removed, and replaced, without exposure to busses or contact members.

2. A fuse as claimed in claim 1, including four pads on a top surface of said support member, said pads arranged in pairs spaced laterally, the pads of each pair spaced longitudinally, a pad on each side of one of said apertures in the support member, said fuse element holder guided by said pads.

3. A fuse as claimed in claim 2, said fuse element holder including an elongate main portion extending between said pairs of pads and sliding over said support member.

4. A fuse as claimed in claim 3, said holder further including two end sections and a center section therebetween, said end sections defining, with said center section, two spaced apart channels, said channels defining said fuse element mounting positions.

5. A fuse as claimed in claim 4, each of said contact members having a transverse slot opening towards each other, for reception of end members on said fuse elements.

6. A fuse as claimed in claim 5, said end sections and said center section of said holder including laterally extending flanges, said flanges a close sliding fit in said transverse slots.

7. A fuse as claimed in claim 1, including a removable cover in each aperture.

8. A fuse as claimed in claim 4, including an aperture in said holder in each of said channels, and a porous member in each aperture.

9. A fuse as claimed in claim 1, including an alarm fuse mounted in said cover.

* * * * *